US012808183B2

(12) United States Patent
Long

(10) Patent No.: US 12,808,183 B2
(45) Date of Patent: Nov. 24, 2026

(54) CURTAIN WALL INSULATION SYSTEM WITH IMPROVED INSULATION SEAM

(71) Applicant: Owens Corning Intellectual Capital, LLC, Toledo, OH (US)

(72) Inventor: Jack Long, Fort Wayne, IN (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 114 days.

(21) Appl. No.: 18/814,838

(22) Filed: Aug. 26, 2024

(65) Prior Publication Data

US 2025/0084634 A1 Mar. 13, 2025

Related U.S. Application Data

(60) Provisional application No. 63/581,040, filed on Sep. 7, 2023.

(51) Int. Cl.
*E04B 1/76* (2006.01)
*E04B 1/80* (2006.01)
(Continued)

(52) U.S. Cl.
CPC ..... *E04B 1/7654* (2013.01); *E04B 1/80* (2013.01); *E04B 1/942* (2013.01); *E04B 2/96* (2013.01)

(58) Field of Classification Search
CPC ..... E04B 1/6125; E04B 1/7654; E04B 1/80; E04B 1/942; E04B 2/96; E04B 2001/7679
(Continued)

(56) References Cited

U.S. PATENT DOCUMENTS 2,059,664 A * 11/1936 Tashjian ..... E04B 1/942 52/592.1
2,915,795 A * 12/1959 Kendall ..... E04B 1/62 52/468
(Continued)

FOREIGN PATENT DOCUMENTS

AT 5915 U1 1/2003

OTHER PUBLICATIONS

International Search Report and Written Opinion from PCT/US2024/043812 dated Nov. 27, 2024.
(Continued)

*Primary Examiner* — James M Ference
(74) *Attorney, Agent, or Firm* — Calfee, Halter & Griswold LLP

(57) ABSTRACT

A system for insulating a curtain wall structure includes framing defined by vertically disposed and parallel mullions separated by a mullion distance; a first curtain wall insulation panel disposed within the framing and having a longitudinally extending indentation; and a second curtain wall insulation panel disposed within the framing and having a longitudinally extending protrusion. The curtain wall insulation panels are disposed within the framing such that the protrusion of the second panel is at least partially disposed within the indentation of the first panel. The panels can be comprised of mineral wool. The system has a flame rating of at least 2 hours, as measured in accordance with ASTM E2307. Also provided are an insulated curtain wall component that includes similar first and second curtain wall insulation panels and a curtain wall insulation panel suitable for use in the systems and components described herein.

19 Claims, 4 Drawing Sheets

(51) Int. Cl.
*E04B 1/94* (2006.01)
*E04B 2/96* (2006.01)

(58) Field of Classification Search
USPC ..... 52/235
See application file for complete search history.

(56) References Cited

U.S. PATENT DOCUMENTS 3,093,217 A * 6/1963 Doede ..... E06B 3/26305 52/235
3,315,429 A * 4/1967 Swanson ..... E04F 13/12 52/529
3,449,879 A * 6/1969 Bloom ..... E04C 2/043 52/471
3,474,584 A * 10/1969 Lynch ..... E04C 2/243 52/592.4
3,509,672 A * 5/1970 Brooks ..... E04B 2/96 52/235
3,665,664 A * 5/1972 Watson ..... E04B 1/14 52/211
3,936,986 A * 2/1976 Steel ..... E04B 2/94 52/378
4,291,511 A * 9/1981 Stoakes ..... E04B 2/94 52/235
4,449,341 A * 5/1984 Taglianetti ..... E04B 2/88 52/235
4,833,855 A * 5/1989 Winter, IV ..... E04C 2/288 52/591.4
4,907,383 A * 3/1990 Winter, IV ..... E04C 2/288 52/309.9
5,119,612 A * 6/1992 Taylor ..... E04D 13/1637 52/410
5,154,029 A * 10/1992 Sturgeon ..... E04F 13/12 52/95
5,158,392 A * 10/1992 Takeda ..... E04F 13/0808 52/235
5,268,226 A * 12/1993 Sweeney ..... C04B 16/08 428/903.3
5,333,428 A * 8/1994 Taylor ..... E06B 3/66 264/254
5,502,937 A * 4/1996 Wilson ..... B32B 15/20 52/273
5,743,056 A * 4/1998 Balla-Goddard ..... E04C 2/296 52/794.1
5,749,282 A * 5/1998 Brow ..... E04H 5/10 52/302.1
5,761,864 A * 6/1998 Nonoshita ..... E04D 13/17 52/95
5,974,750 A * 11/1999 Landin ..... E04B 1/948 52/573.1
7,424,793 B1 * 9/2008 Shriver ..... E04B 2/88 52/235
8,082,715 B2 * 12/2011 Shaw ..... E04B 1/948 52/396.04
8,671,645 B1 * 3/2014 Shriver ..... E04B 2/88 52/235
8,769,898 B2 * 7/2014 Carolan ..... E04B 2/90 52/235
8,869,492 B2 * 10/2014 Leahy ..... E04C 2/521 52/592.1
8,959,855 B2 * 2/2015 Evensen ..... E06B 1/18 52/204.593
9,309,671 B2 * 4/2016 Van Sloun ..... B32B 3/06
9,482,381 B1 * 11/2016 Hjelt ..... B29C 41/003
11,414,865 B2 * 8/2022 Sealock ..... E04C 2/00
11,459,749 B2 * 10/2022 Harder ..... E04B 1/947
11,486,137 B2 * 11/2022 Klein ..... E04B 1/948
2002/0144480 A1 * 10/2002 Sagnard ..... E04D 13/1631 428/57
2005/0183367 A1 * 8/2005 Lembo ..... E04B 1/7662 52/404.1
2006/0016133 A1 * 1/2006 Speck ..... E04B 2/90 52/79.1
2006/0019568 A1 * 1/2006 Toas ..... E04B 1/80 442/381
2007/0204540 A1 * 9/2007 Stahl ..... E04B 5/00 52/274
2009/0007507 A1 * 1/2009 Zhai ..... E04C 3/07 52/285.1
2010/0107532 A1 * 5/2010 Shriver ..... E04B 1/947 52/489.1
2010/0297380 A1 * 11/2010 Szakola ..... E04C 2/292 428/56
2011/0154746 A1 * 6/2011 Hill ..... E04B 1/26 52/293.3
2013/0067838 A1 * 3/2013 Black ..... E04B 1/80 52/794.1
2016/0130820 A1 * 5/2016 Cullen ..... E04C 2/284 52/745.1
2016/0356034 A1 * 12/2016 Andresen ..... E04B 2/88
2017/0284085 A1 * 10/2017 Ting ..... E04B 1/942
2018/0030724 A1 * 2/2018 Schulz-Hanke ..... E04B 2/88
2018/0058748 A1 * 3/2018 Costanza ..... E04B 1/6183
2018/0073797 A1 * 3/2018 Taqi ..... E04B 1/6141
2018/0106034 A1 * 4/2018 Hulteen ..... E04B 2/7411
2018/0179754 A1 * 6/2018 Karnicki ..... B32B 21/042
2018/0187414 A1 * 7/2018 Kennedy ..... E04B 2/96
2019/0063064 A1 * 2/2019 Paetow ..... E04B 1/948
2019/0309514 A1 * 10/2019 Stahl, Jr. ..... E04B 2/965
2020/0010733 A1 * 1/2020 Hulteen ..... E04B 1/948
2020/0056073 A1 * 2/2020 Hulteen ..... E04B 1/948
2020/0332525 A1 * 10/2020 Klein ..... E04B 1/94
2021/0238845 A1 * 8/2021 Bickford ..... B32B 9/041
2022/0136236 A1 * 5/2022 O'Meara ..... B32B 3/06 52/232
2022/0259856 A1 * 8/2022 Lahti ..... E04C 2/46
2023/0068921 A1 * 3/2023 Boyce ..... F16L 59/028
2023/0160201 A1 * 5/2023 Long ..... E04B 2/96 52/235
2024/0026680 A1 * 1/2024 Long ..... E04B 2/96
2025/0084634 A1 * 3/2025 Long ..... E04B 1/80

OTHER PUBLICATIONS

GUTEX Wood Fiber Insulation Boards, downloaded from: https://www.d-a.ch/da/kunden-referenzen/aktuelles/blog/gutex-holzfaserdaemmplatten.html, available at least as early as Jun. 8, 2023.

PFLAUM Mineral Wool Panels, downloaded from: https://www.pflaum.at/en/product/view/pflaum-fei, available at least as early as Jun. 8, 2023.

* cited by examiner

CURTAIN WALL INSULATION SYSTEM WITH IMPROVED INSULATION SEAM

CROSS-REFERENCE TO RELATED APPLICATION

This application claims priority to and the benefit of U.S. Provisional Patent Application No. 63/581,040, filed Sep. 7, 2023, the entire disclosure of which is incorporated by reference herein.

FIELD

The general inventive concepts relate to insulation systems for inhibiting a fire from moving between adjacent floors of a building and, more particularly, to a system for insulating a curtain wall structure that includes a first insulation panel abutting a second insulation panel with an improved seam formed therebetween, as well as an insulated curtain wall component that includes the improved seam.

BACKGROUND

Curtain wall insulation systems are commonly used to insulate adjacent floors of buildings that include curtain wall structures. In particular, the curtain wall insulation systems are used to provide thermal insulation and to inhibit the spread of fire from one floor to an upper adjacent floor through perimeter voids between an edge of a floor slab and the exterior building structure, which is sometimes referred to as the safing slot area, as well as through voids within the curtain wall structures.

A curtain wall structure is a non-load bearing type of exterior wall system that is utilized on buildings, such as high-rise buildings. The curtain wall structures generally utilize lightweight materials. Conventional curtain wall structures include framing composed of vertical framing members, referred to as mullions, and horizontal framing members, referred to as transoms. The mullions and transoms are typically hollow box-shaped members formed of aluminum. The vertical mullions are parallel to one another and separated by a mullion distance, and the horizontal transoms are parallel to one another and separated by a transom distance. The mullion distance is sometimes referred to as a daylight opening width since a view through the gap between the mullions is not obstructed by the mullions. Curtain wall structures also include spandrel panels to provide an exterior facing thereof and are commonly made of glass (e.g., vision glass, opaque glass), aluminum, stone, thin sheets of foam material, and the like.

Curtain wall insulation systems and structures may also include a curtain wall insulation panel that fills a void within framing formed by the mullions and transoms to insulate an interior of the building from exterior temperatures and to inhibit the spread of fire through the curtain wall structure. To limit any voids within the framing through which fire might pass, the curtain wall insulation panel spans the aforementioned mullion distance. Fabrication methods, packaging constraints, and/or shipping constraints have limited some curtain wall insulation panels to a maximum length of 72 inches (1,829 mm).

An example of a conventional system 10 for insulating a curtain wall structure 50 that includes a curtain wall insulation panel 80 is partially illustrated in FIG. 1. As seen in FIG. 1, the curtain wall structure 50 is spaced from a floor slab 60 of the building structure (not shown) to define a perimeter void 65. The curtain wall structure 50 includes framing defined by at least first and second vertically disposed and parallel mullions 51, 52 separated by a mullion distance $M_D$ and at least first and second horizontally disposed transoms 53, 54 separated by a transom distance. The curtain wall insulation panel 80 has a length that spans the mullion distance $M_D$. As noted above, this conventional the curtain wall insulation panel 80 has a maximum length of 72 inches (1,829 mm). Accordingly, the system 10 is limited to a mullion distance $M_D$ of 72 inches (1,829 mm) or less. In addition, the curtain wall structure 50 includes at least one spandrel panel 55 connected to the mullions 51, 52 and transoms 53, 54 and at least one vision glass 56 connected to the mullions 51, 52 and transoms 53, 54, with an air gap situated between the framing and both the spandrel panel 55 and the vision glass 56. Further, safing insulation 90 is disposed within the perimeter void 65 and is compression fit between the mullions 51, 52 and the floor slab 60. The system 10 may also include a smoke sealant (not shown) that is applied atop the safing insulation, as well as mullion cover insulation (not shown) that is attached to mullions 51, 52. Furthermore, the curtain wall insulation 80 may be friction fit between the mullions 51, 52 and transoms 53, 54 and be adjacent to the spandrel panel 55 and/or the safing insulation 90.

In some high-rise buildings, it is desirable to include a mullion distance of greater than 72 inches (1,829 mm), for example, to widen an unobstructed view through vision glass connected to the framing of the curtain wall structure. Since conventional curtain wall insulation panels have a maximum manufacturable length of 72 inches (1,829 mm), more than one such curtain wall insulation panel is needed to span the mullion distance. However, by including multiple panels within the framing, a vertical seam is formed where two panels abut or otherwise meet. In the event of a fire on a first floor of the building, such a vertical seam may become compromised (e.g., damaged, separated) resulting in an undesirable pathway for flames to pass from the first floor to an adjacent upper floor. For example, during a fire the vertical seam may spread open more widely due to thermal stresses or forces from other nearby components of the high-rise building, thereby permitting flames to pass more easily from the first floor to the adjacent upper floor.

As shown in FIG. 2, another conventional system 12 for insulating a curtain wall structure 50 can include such a vertical seam where a first curtain wall insulation panel 80*a* abuts a second curtain wall insulation panel 80*b*. The vertical seam of FIG. 2 is obscured from view by a false mullion 57. The curtain wall structure 50 includes framing defined by at least first and second vertically disposed and parallel mullions 51, 52 separated by a mullion distance $M_D$ greater than 72 inches (1,829 mm). As mentioned herein, conventional curtain wall insulation panels have typically had a maximum manufacturable length (e.g., 72 inches or 1,829 mm). Accordingly, at least two full and/or partial curtain wall insulation panels 80*a*, 80*b* are needed to span the mullion distance $M_D$, and the vertical seam is formed where the panels 80*a*, 80*b* abut. Since, in the event of a fire, the vertical seam may become compromised and thereby result in an undesirable pathway for flames, the vertical seam is covered by the false mullion 57 to inhibit the vertical seam from spreading open. The false mullion 57 may be attached to the transoms 53, 54 and span the transom distance. As opposed to the box-shaped, aluminum mullions 51, 52 and transoms 53, 54, the false mullion 57 is typically a c-shaped piece of steel that does not extend along a thickness of the curtain wall insulation panels 80*a*, 80*b*.

However, the false mullion 57 contributes additional material costs to the system, as well as additional labor for installation.

Accordingly, there is an unmet need in the art for an improved system for insulating a curtain wall structure that permits a mullion distance greater than a maximum manufacturable length of a curtain wall insulation panel but does not require conventional seam reinforcing members (e.g., a false mullion) to be applied at a vertical seam between adjacent curtain wall insulation panels.

SUMMARY

The general inventive concepts relate to and contemplate a system for insulating a curtain wall structure that includes a curtain wall insulation panel, an insulated curtain wall component that includes a curtain wall insulation panel, and a curtain wall insulation panel suitable for use in the systems and components described herein. The system and insulated curtain wall component include a curtain wall insulation panel having an improved design such that no separate reinforcing members are required to be applied at a vertical seam between adjacent curtain wall insulation panels. Accordingly, the system and insulated curtain wall component of the present disclosure include fewer parts, thereby reducing material costs and installation costs, while also inhibiting a flame pathway from forming at the vertical seam. To illustrate various aspects of the general inventive concepts, several exemplary embodiments of insulating systems, insulated curtain wall components, and curtain wall insulation panels are disclosed.

In accordance with one aspect of the present disclosure, a system for insulating a curtain wall structure connected to a building structure is provided. The curtain wall structure is spaced from a floor slab of the building structure to define a perimeter void. The curtain wall structure includes framing defined by at least first and second vertically disposed and parallel mullions, which are separated by a mullion distance. The framing can be further defined by at least first and second horizontally disposed and parallel transoms, which are separated by a transom distance. The system includes a first curtain wall insulation panel disposed within the framing. The first curtain wall insulation panel has a first face (e.g., an interior facing surface), a second face (e.g., an exterior facing surface) opposite the first face, and a material thickness defined between the first face and the second face. The first curtain wall insulation panel further includes a first end having a longitudinally extending indentation, and a second end opposite the first end with a first material length defined between the first end and the second end. As used herein, the term "longitudinally extending indentation" means that a depth of a longitudinally extending indentation extends in a direction along a length (e.g., a material length) of a panel having the longitudinally extending indentation.

The system further includes a second curtain wall insulation panel disposed within the framing. The second curtain wall insulation panel has a first face (e.g., an interior facing surface), a second face (e.g., an exterior facing surface) opposite the first face, and a material thickness defined between the first face and the second face. The second curtain wall insulation panel further includes a first end having a longitudinally extending protrusion, and a second end opposite the first end with a second material length between the first end and the second end. As used herein, the term "longitudinally extending protrusion" means that a depth of a longitudinally extending protrusion extends in a direction along a length (e.g., a material length) of a panel having the longitudinally extending protrusion. The first and second curtain wall insulation panels are disposed within the framing such that the longitudinally extending protrusion of the second curtain wall insulation panel is at least partially disposed within the longitudinally extending indentation of the first curtain wall insulation panel.

For at least the first two (2) hours of a fire on a floor below and adjacent to the first and second curtain wall insulation panels, the longitudinally extending protrusion remains at least partially disposed within the longitudinally extending indentation. Further, a sum of the first material length and the second material length comprises a summed material length that is greater than or approximately equal to an installed length of the first panel and the second panel. For at least the first two (2) hours of a fire on a floor below and adjacent to the first and second curtain wall insulation panels, the summed material length remains greater than or approximately equal to an installed length of the first panel and the second panel. The installed length is at least approximately equal to the mullion distance, where the mullion distance may be at least about a maximum manufacturable length of the first panel or the second panel (e.g., about 72 inches, about 1,829 mm, or more). The system has a flame rating of at least 2 hours or longer, as measured in accordance with ASTM E2307. In various embodiments, the system has a flame rating of at least 30 minutes, 60 minutes, 90 minutes, or longer. In various embodiments the longitudinally extending protrusion is at least partially disposed within the longitudinally extending indentation for at least 30 minutes, 60 minutes, 90 minutes, or longer. In various embodiments the summed material length is greater than or at least approximately equal to the installed length for at least 30 minutes, 60 minutes, 90 minutes, or longer.

In accordance with another aspect of the present disclosure, an insulated curtain wall component is provided. The insulated curtain wall component includes framing defined by at least first and second vertically disposed and parallel mullions separated by a mullion distance. The framing can be further defined by at least first and second horizontally disposed and parallel transoms, which are separated by a transom distance. The insulated curtain wall component includes a first curtain wall insulation panel disposed within the framing. The first curtain wall insulation panel has an interior facing surface, an exterior facing surface opposite the interior facing surface, and a material thickness defined therebetween. The first curtain wall insulation panel further includes a first end having a longitudinally extending indentation, a second end opposite the first end, and a first material length defined between the first end and the second end.

The insulated curtain wall component further includes a second curtain wall insulation panel disposed within the framing. The second curtain wall insulation panel has an interior facing surface, an exterior facing surface opposite the interior facing surface, and a material thickness defined therebetween. The second curtain wall insulation panel further includes a first end having a longitudinally extending protrusion, a second end opposite the first end, and a second material length defined between the first end and the second end. The first and second curtain wall insulation panels are disposed within the framing such that the longitudinally extending protrusion of the second curtain wall insulation panel is at least partially disposed within the longitudinally extending indentation of the first curtain wall insulation panel. For at least the first two (2) hours of a fire on a floor below and adjacent to the first and second curtain wall insulation panels, the longitudinally extending protrusion remains at least partially disposed within the longitudinally extending indentation. Further, a sum of the first material length and the second material length comprises a summed material length that is greater than or approximately equal to an installed length of the first panel and the second panel. For at least the first two (2) hours of a fire on a floor below and adjacent to the first and second curtain wall insulation panels, the summed material length remains to be greater than or approximately equal to an installed length of the first panel and the second panel. The installed length is at least approximately equal to the mullion distance, where the mullion distance may be at least about a maximum manufacturable length of the first panel or the second panel (e.g., about 72 inches, about 1,829 mm, or more). The insulated curtain wall component has a flame rating of at least 2 hours or more, as measured in accordance with ASTM E2307.

In accordance with another aspect of the present disclosure, a curtain wall insulation panel is provided. The curtain wall insulation panel has an interior facing surface, an exterior facing surface opposite the interior facing surface with a material thickness defined therebetween. The curtain wall insulation panel further includes a first end having a longitudinally extending indentation, and a second end opposite the first end with a first material length defined therebetween. The second end may include a longitudinally extending protrusion. The curtain wall insulation panel is suitable for use in the systems and components described herein. The curtain wall insulation panel can interface with a second curtain wall insulation panel such that a longitudinally extending protrusion of the second curtain wall insulation panel is at least partially disposed within the longitudinally extending indentation of the curtain wall insulation panel.

In accordance with another aspect of the present disclosure, a curtain wall insulation panel is provided. The curtain wall insulation panel has an interior facing surface, an exterior facing surface opposite the interior facing surface with a material thickness defined therebetween. The curtain wall insulation panel further includes a first end having a longitudinally extending protrusion, and a second end opposite the first end with a first material length defined therebetween. The second end may include a longitudinally extending indentation. The curtain wall insulation panel is suitable for use in the systems and components described herein. The curtain wall insulation panel can interface with a second curtain wall insulation panel such that the longitudinally extending protrusion of the curtain wall insulation panel is at least partially disposed within a longitudinally extending indentation of the second curtain wall insulation panel.

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which.

DETAILED DESCRIPTION

Several illustrative embodiments will be described in detail with the understanding that the present disclosure merely exemplifies the general inventive concepts. Embodiments encompassing the general inventive concepts may take various forms and the general inventive concepts are not intended to be limited to the specific embodiments described and illustrated herein.

Figure 1:
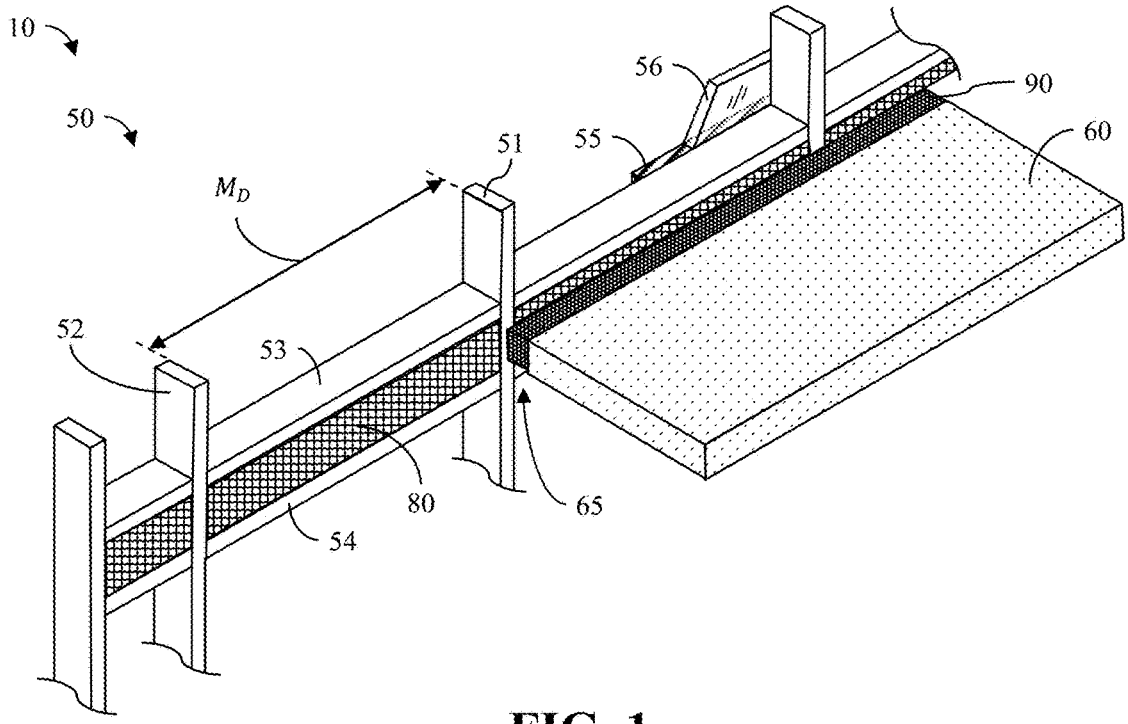
FIG. 1 PRIOR ART
FIG. 1 is a perspective partial cutaway view of a system for insulating a curtain wall structure that includes a conventional curtain wall insulation panel.
Figure 2:
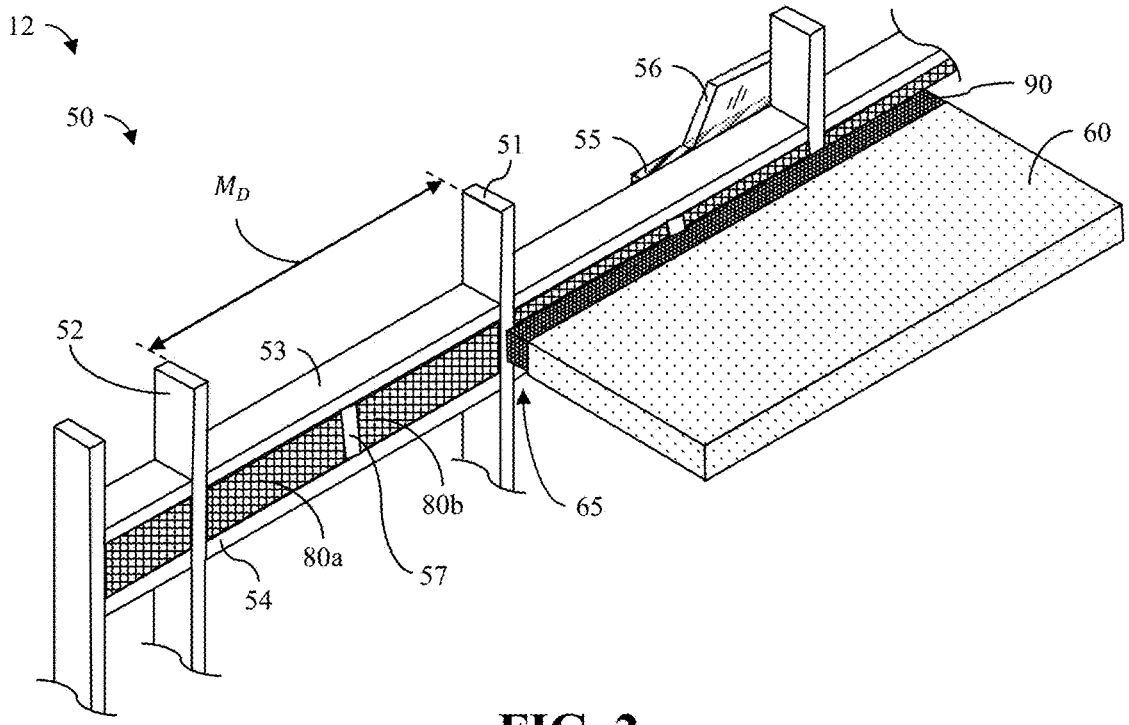
FIG. 2 PRIOR ART
FIG. 2 is a perspective partial cutaway view of a system for insulating a curtain wall structure that includes conventional curtain wall insulation panels.

The general inventive concepts relate to systems for insulating a curtain wall structure connected to a building structure, to insulated curtain wall components that are prefabricated off-site prior to being installed at a construction site, and to curtain wall insulation panels suitable for use in systems and components described herein. The systems and insulated curtain wall components include an innovative curtain wall insulation panel to insulate a curtain wall structure and provide perimeter firestop protection. The curtain wall insulation panel is configured such that separate reinforcing members, such as the false mullion 57 used in the conventional system 12 shown in FIG. 2, are not required to be applied at a vertical seam between the curtain wall insulation panel and a second curtain wall insulation panel to achieve a flame rating (F rating) of at least 2 hours, as measured in accordance with ASTM E2307: Standard Test Method for Determining Fire Resistance of Perimeter Fire Barrier Systems Using Intermediate-Scale, Multi-story Test Apparatus. Accordingly, the systems and insulated curtain wall components of the present disclosure include fewer parts, thereby reducing material costs and installation costs, while also inhibiting a flame pathway from forming at the vertical seam. Moreover, the systems and insulated curtain wall components of the present disclosure can include a false mullion 57, and these systems and components could remain effective at inhibiting a flame pathway from forming at the vertical seam even if the false mullion 57 becomes compromised during a fire.

The curtain wall insulation panel of the present disclosure can be a fire-rated insulation panel comprising, for example, mineral wool. A method of making the curtain wall insulation panel includes forming (e.g., routing, cutting, integrally forming) a longitudinally extending indentation (i.e., a groove) on, along, from, or within a first end of the panel and a longitudinally extending protrusion (i.e., a tongue) on, along, or from a second end of the panel opposite the first end. A method of making a first curtain wall insulation panel includes forming a longitudinally extending indentation on, along, from, or within a first end of the first panel. A method of making a second curtain wall insulation panel includes forming a longitudinally extending protrusion on, along, from, or within a first end of the second panel. A method of forming a seam between the first panel and the second panel includes abutting the first end of the first panel and the first end of the second panel such that the longitudinally extending protrusion is at least partially (if not entirely) disposed within the longitudinally extending indentation. Advantageously, such a seam does not provide a pathway for flames to pass therethrough. Furthermore, the seam construction limits or prevents the seam from spreading open when exposed to a fire.

Figure 3:
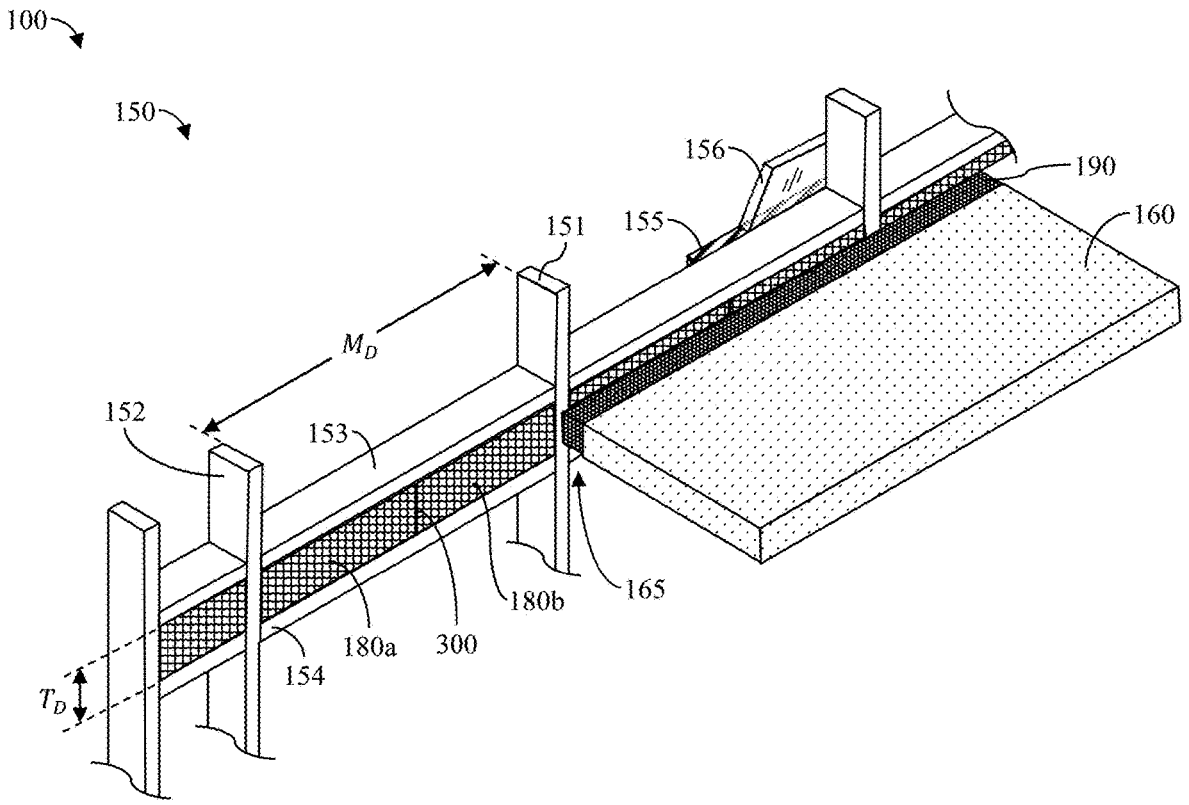
FIG. 3 is a perspective partial cutaway view of a system for insulating a curtain wall structure that includes exemplary curtain wall insulation panels in accordance with the present disclosure.

An embodiment of a system 100 for insulating a curtain wall structure 150 in accordance with the present disclosure is shown in FIG. 3. The system 100 is useful for insulating a curtain wall structure 150 connected to a building structure (not shown), as well as providing perimeter firestop protection. A curtain wall structure 150 is a type of exterior wall system commonly used on multi-floor buildings, such as high-rise buildings, wherein the curtain wall structure 150 does not bear the load of the building structure. As seen in FIG. 3, the curtain wall structure 150 is spaced from a floor slab 160 of the building structure to define a perimeter void 165. The curtain wall structure 150 includes framing defined by at least first and second vertically disposed and parallel mullions, such as a first vertically disposed mullion 151 and a second vertically disposed mullion 152. The mullions 151, 152 are separated by a mullion distance $M_D$, which corresponds to the distance between a first surface of the first mullion 151 that faces the second mullion 152 and a second surface of the second mullion 152 that faces the first mullion 151. In other words, the mullion distance $M_D$ is a width of an opening formed between the mullions 151, 152. The mullion distance $M_D$ can be any suitable size. In some embodiments, the mullion distance $M_D$ is greater than or equal to about a maximum manufacturable length of a curtain wall insulation panel (e.g., about 72 inches, about 1,829 mm, or more). The frame can be further defined by at least first and second horizontally disposed and parallel transoms, such as an upper horizontally disposed transom 153 and a lower horizontally disposed transom 154. The transoms 153, 154 are separated by a transom distance $T_D$, which corresponds to the distance between a bottom surface of the upper transom 153 and a top surface of the lower transom 154. In other words, the transom distance $T_D$ is a height of an opening formed between the transoms 153, 154. The transom distance $T_D$ can be any suitable size. In some embodiments, the transom distance $T_D$ is less than or equal to about 24 inches (about 610 mm), such as about 6 inches (about 152 mm) or less. The mullions 151, 152 and transoms 153, 154 may be hollow box-shaped members formed of aluminum. As shown in FIG. 3, the curtain wall structure 150 can also include a spandrel panel 155 connected to the framing. The spandrel panel 155 provides an exterior façade of the curtain wall structure 150 and is commonly formed of glass, aluminum, stone, thin sheets of foam material, and the like. In addition, the curtain wall structure 150 can include vision glass 156 connected to the framing. The system 100 provides thermal insulation and also provides a barrier to inhibit the spread of fire from one floor of a building to an upper adjacent floor through the perimeter void 165.

With continued reference to FIG. 3, the system 100 includes a first curtain wall insulation panel 180*a* and a second curtain wall insulation panel 180*b* disposed within the framing. The first insulation panel 180*a* includes a first end having a longitudinally extending indentation and a second end opposite the first end with a first material length defined therebetween. The second insulation panel 180*b* includes a first end having a longitudinally extending protrusion and a second end opposite the first end with a second material length defined therebetween. The first and second insulation panels 180*a*, 180*b* are disposed within the framing such that the first end of the first insulation panel 180 abuts the first end of the second insulation panel 180*b* to form a seam 300. Further, the first and second insulation panels 180*a*, 180*b* are disposed within the framing such that the longitudinally extending protrusion of the second insulation panel 180*b* is at least partially disposed within the longitudinally extending indentation of the first curtain wall insulation panel 180*a*. In other words the first and second insulation panels 180*a*, 180*b* interface in a tongue-and-groove fashion to form the seam 300.

Moreover, the first insulation panel 180*a* has a first material length measured from the first end to the second end of the insulation panel 180*a*, and the second insulation panel 180*b* has a second material length measured from the first end to the second end of the insulation panel 180*b*. The first material length and the second material length can be summed to form a summed material length. Further, an installed length of the first insulation panel 180*a* and the second insulation panel 180*b* can be measured from the second end of the first insulation panel 180*a* to the second end of the second insulation panel 180*b*. The summed material length is greater than or approximately equal to the installed length, for example, since the longitudinally extending protrusion is at least partially disposed within the longitudinally extending indentation, thereby effectively reducing the installed length. The installed length may be at least approximately equal to the mullion distance $M_D$, for example, such that the insulation panels 180*a*, 180*b* are compression fit between the mullions 151, 152. The second end of the first insulation panel 180*a* can abut the second mullion 152. The second end of the second insulation panel 180*b* can abut the first mullion 151. Exterior facing surfaces of the insulation panels 180*a*, 180*b* can face the spandrel panel 155.

As shown in FIG. 3, the system 100 of the present disclosure also includes a safing insulation 190 disposed within the perimeter void 165 and compression fit between the floor slab 160 and at least one of the framing (e.g., mullion 151 or 152) or the curtain wall insulation panel 180*a* or 180*b*. In embodiments, an interior facing surface of at least one of the insulation panels 180*a*, 180*b* abuts the safing insulation 190. The safing insulation 190 inhibits flames and hot gases from moving from one floor to an adjacent upper floor through the perimeter void 165. The safing insulation 190 may be formed of various materials based on a desired failure temperature of the material. In certain embodiments, the safing insulation 190 comprises mineral wool. The safing insulation 190 may have a thickness of at least about 1 inch (about 25.4 mm) to about 8 inches (about 203.2 mm) or more and a density of at least about 64 $kg/m^3$ to about 225 $kg/m^3$ or more. Such safing insulation 190 is commercially available from Thermafiber, Inc. (Joplin, Missouri). When installed, the safing insulation 190 is typically compressed to varying degrees, but normally it is compressed to at least about 25% of its original thickness. After installation, the safing insulation 190 provides fireproof sealing of the perimeter void 165. Because the safing insulation 190 is compressed when installed, it provides some capability to expand which can seal openings or cracks that might otherwise develop in the perimeter void 165. Slight variations in the size of the perimeter void 165 due to expansion or other environmental changes are accommodated by the safing insulation 190 since it is compressed when placed in the perimeter void 165, and thus can provide an effective seal under various conditions.

In certain aspects, the system 100 is arranged such that a top surface of the safing insulation 190 is separated from the bottom surface of the upper transom 153 by a vertical distance of at least about 1 inch (about 25.4 mm), at least about 2 inches (about 50.8 mm), at least about 4 inches (about 101.6 mm), etc. or by a vertical distance of about 4 inches (about 101.6 mm) to about 12.6 inches (about 320 mm). In certain aspects, the system 100 is arranged such that a bottom surface of the safing insulation 190 is separated from the top surface of the lower transom 154 by a vertical distance of at least about 1 inch (about 25.4 mm), at least about 2 inches (about 50.8 mm), at least about 4 inches (about 101.6 mm), etc. or by a vertical distance of about 4 inches (about 101.6 mm) to about 12.6 inches (about 320 mm). The components of the present system 100, and particularly the curtain wall insulation panels 180*a*, 180*b*, allow arrangements where the transoms 153, 154 are vertically separated from the safing insulation 190 without requiring a reinforcing member at the seam 300 between the panels 180*a*, 180*b*. Accordingly, the system 100 of the present disclosure provides more design freedom as opposed to conventional systems.

Figure 4:
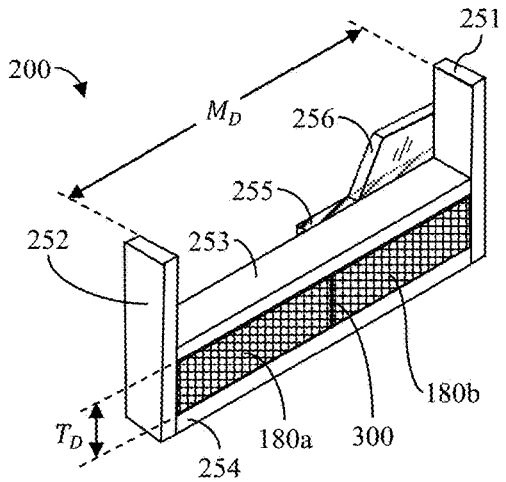
FIG. 4 is a perspective partial cutaway view of an embodiment of an insulated curtain wall component that includes exemplary curtain wall insulation panels in accordance with the present disclosure.

Referring now to FIG. 4, an embodiment of an insulated curtain wall component 200 is illustrated. The insulated curtain wall component 200 may be used to form at least a portion of a curtain wall unit of a unitized curtain wall system. In a unitized curtain wall system, individual curtain wall units are prefabricated in a factory setting and then delivered to a construction site for installation. As seen in FIG. 4, the insulated curtain wall component 200 includes framing defined by at least first and second vertically disposed and parallel mullions 251, 252. The mullions 251, 252 are separated by a mullion distance $M_D$, which corresponds to the distance between a first surface of the first mullion 251 that faces the second mullion 252 and a second surface of the second mullion 252 that faces the first mullion 251. In other words, the mullion distance $M_D$ is a width of an opening formed between the mullions 251, 252. The mullion distance $M_D$ can be any suitable size. In some embodiments, the mullion distance $M_D$ is greater than or equal to a maximum manufacturable length of the first panel or the second panel (e.g., about 72 inches, about 1,829 mm, or more). The framing can be further defined by at least first and second horizontally disposed and parallel transoms, such as an upper horizontally disposed transom 253 and a lower horizontally disposed transom 254. The transoms 253, 254 are separated by a transom distance $T_D$, which corresponds to the distance between a bottom surface of the upper transom 253 and a top surface of the lower transom 254. In other words, the transom distance $T_D$ is a height of an opening formed between the transoms 253, 254. The transom distance $T_D$ can be any suitable size. In some embodiments, the transom distance $T_D$ is less than or equal to about 24 inches (about 610 mm), such as about 6 inches (about 152 mm) or less. The mullions 251, 252 and transoms 253, 254 can be hollow box-shaped members formed of aluminum. The insulated curtain wall component 200 may also include a spandrel panel 255 connected to the framing. The spandrel panel 255 provides an exterior façade and is commonly formed of glass, aluminum, stone, thin sheets of foam material, and the like. Further, the insulated curtain wall component 200 may include vision glass 256 connected to the framing.

With continued reference to FIG. 4, the insulated curtain wall component 200 includes a first curtain wall insulation panel 180*a* and a second curtain wall insulation panel 180*b* disposed within the framing. The first insulation panel 180*a* includes a first end having a longitudinally extending indentation, and a second end opposite the first end with a first material length defined therebetween. The second insulation panel 180*b* includes a first end having a longitudinally extending protrusion, and a second end opposite the first end with a second material length defined therebetween. The first and second insulation panels 180*a*, 180*b* are disposed within the framing such that the first end of the first insulation panel 180 abuts the first end of the second insulation panel 180*b* to form a seam 300. Further, the first and second insulation panels 180*a*, 180*b* are disposed within the framing such that the longitudinally extending protrusion of the second insulation panel 180*b* is at least partially disposed within the longitudinally extending indentation of the first curtain wall insulation panel 180*a*. In other words the first and second insulation panels 180*a*, 180*b* interface in a tongue-and-groove fashion to form the seam 300.

Moreover, the first insulation panel 180*a* has a first material length measured from the first end to the second end of the insulation panel 180*a*, and the second insulation panel 180*b* has a second material length measured from the first end to the second end of the insulation panel 180*b*. The first material length and the second material length can be summed to form a summed material length. Further, an installed length of the first insulation panel 180*a* and the second insulation panel 180*b* can be measured from the second end of the first insulation panel 180*a* to the second end of the second insulation panel 180*b*. The summed material length is greater than or approximately equal to the installed length, for example, since the longitudinally extending protrusion is at least partially disposed within the longitudinally extending indentation, thereby effectively reducing the installed length. The installed length may be at least approximately equal to the mullion distance $M_D$, for example, such that the insulation panels 180*a*, 180*b* are compression fit between the mullions 251, 252. The second end of the first insulation panel 180*a* can abut the second mullion 252. The second end of the second insulation panel 180*b* can abut the first mullion 251.

Figure 5:
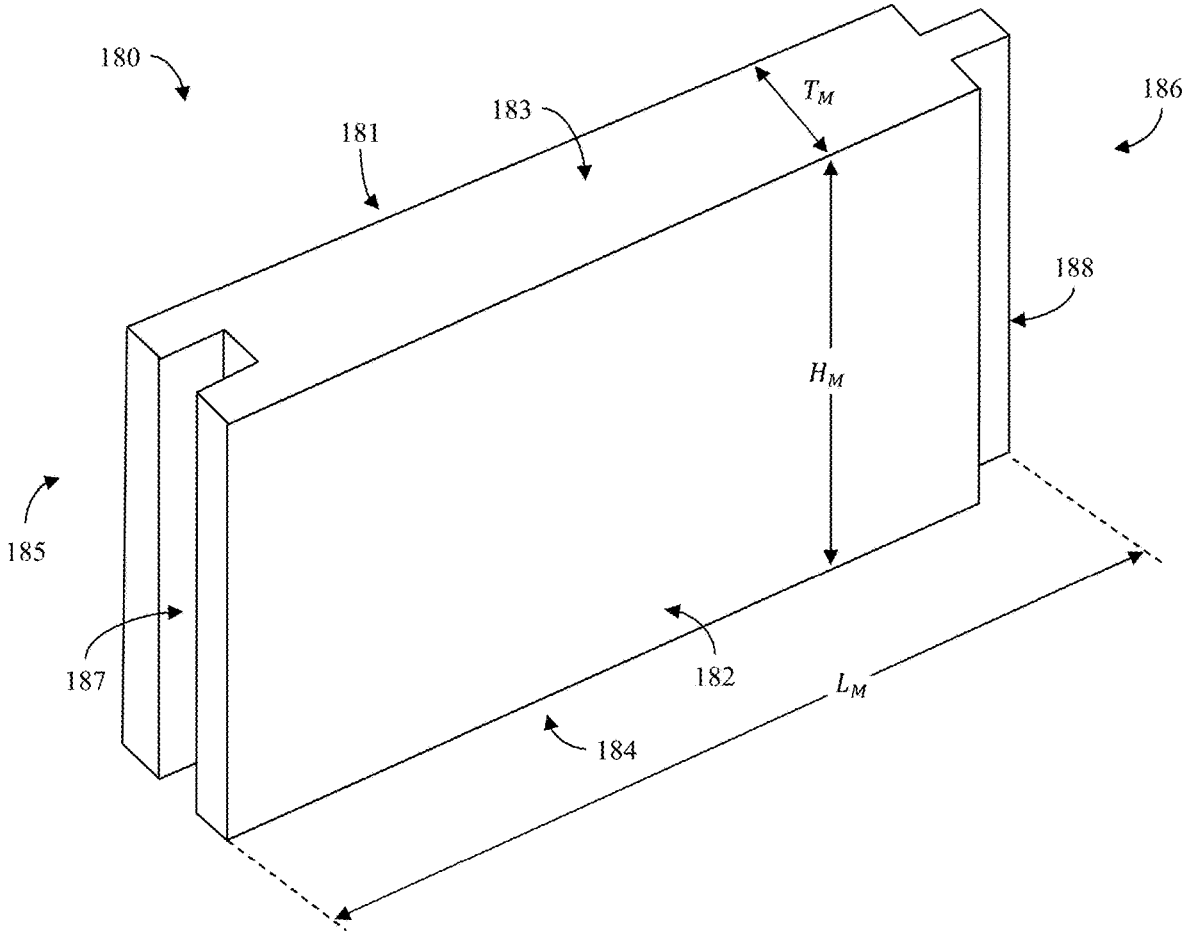
FIG. 5 is a perspective view of an exemplary embodiment of a curtain wall insulation panel in accordance with the present disclosure.

Now referring to FIG. 5, a curtain wall insulation panel 180 (e.g., the first insulation panel 180*a*, the second insulation panel 180*b*) has an exterior facing surface 181 and an interior facing surface 182. The exterior facing surface 181 may be the same as or different from the interior facing surface 182. The exterior facing surface 181 and the interior facing surface 182 are substantially parallel and opposed with a material thickness $T_M$ defined therebetween. In an embodiment, the material thickness is at least about 1 inch (about 25.4 mm) or more, such as at least about 2 inches (about 50.8 mm) or more, at least about 3 inches (about 76.2 mm) or more, etc. The interior facing surface 182 can abut safing insulation 190. The exterior facing surface 181 can face the spandrel panel 155.

Further, the curtain wall insulation panel 180 has an upper surface 183 and a lower surface 184. The upper surface 183 and the lower surface 184 can be the same or different. The upper surface 183 and the lower surface 184 are substantially parallel and opposed with a material height $H_M$ defined therebetween. The upper surface 183 can abut the upper transom 153. The lower surface 184 can abut the lower transom 154. The material height $H_M$ can be greater than or approximately equal to the transom distance $T_D$, for example, such that the curtain wall insulation panel 180 is compression fit between the upper transom 153 and the lower transom 154. In embodiments, the material height $H_M$ is less than or equal to about 24 inches (about 610 mm), such as about 6 inches (about 152 mm) or less.

Furthermore, the curtain wall insulation panel has a first end 185 and a second end 186. At least a portion of the first end 185 (e.g., a most extreme portion of the first end 185) and at least a portion of the second end 186 (e.g. a most extreme portion of the second end 186) are substantially parallel and opposed with a material length $L_M$ defined therebetween. The material length $L_M$ can be less than or approximately equal to a maximum manufacturable length of curtain wall insulation panels, such as about 72 inches (about 1,829 mm) or less (e.g., about 48 inches, about 60 inches. The first end 185 can abut the first mullion 151. The second end 186 can abut the second mullion 152.

As shown in FIG. 5, the first end 185 of the curtain wall insulation panel 180 can include an indentation 187 that extends longitudinally inward from the first end 185. The indentation 187 can extend along at least a portion of the material height $H_M$ or along the entire material height $H_M$ of the curtain wall insulation panel 180. The indentation 187 can be disposed on the panel 180 such that a top half of the panel 180 is symmetrical with a bottom half of the panel 180. In other words, the panel 180 is symmetrical about a horizontal plane perpendicular to exterior facing surface 181 and the interior facing surface 182. In another example, the horizontal plane is parallel to and equidistantly disposed between the upper surface 183 and the lower surface 184 of the panel 180. Accordingly, the panel 180 can be installed with the upper surface 183 abutting the lower transom 154 or 254 and with the lower surface 184 abutting the upper transom 153 or 253 without impacting the insulative performance or fire-containing performance of the system 100 or the component 200. A cross-section of the indentation 187 can be substantially semi-circular, U-shaped, square, rectangular, or the like. Further, the cross-section of the indentation 187 can have an opening that is narrower than a main portion of the indentation 187 such that a protrusion of a second curtain wall insulation panel is compression fit within or interlocked with the indentation 187.

Further, as shown in FIG. 5, the second end 186 of the curtain wall insulation panel 180 can comprise a protrusion 188 that extends longitudinally away from a main body portion of the panel (i.e., a portion of the panel disposed between the indentation 187 and the protrusion 188). The protrusion 188 can extend along at least a portion of the material height $H_M$ or along the entire material height $H_M$ of the curtain wall insulation panel 180. The protrusion 188 can be disposed on the panel 180 such that a top half of the panel 180 is symmetrical with a bottom half of the panel 180. In other words, the panel 180 is symmetrical about a horizontal plane perpendicular to exterior facing surface 181 and the interior facing surface 182. In another example, the horizontal plane is parallel to and equidistantly disposed between the upper surface 183 and the lower surface 184 of the panel 180. A cross-section of the protrusion 188 can be substantially semi-circular, U-shaped, square, rectangular, or the like. Further, the cross-section of the protrusion 188 can have a distal end portion that is a different size (e.g., wider, narrower) than a main portion of the protrusion 188 such that the protrusion 188 can be compression fit within or interlocked with an indentation of a second curtain wall insulation panel (e.g., an indentation with an opening that is narrower than a main portion of the indentation).

While FIG. 5 shows the indentation 187 on the first end 185 and the protrusion 188 on the second end 186, the locations of these features can be reversed such that the indentation 187 is on the second end 186 and the protrusion 188 is on the first end 185. Further, while FIG. 5 shows the panel 180 having both the indentation 187 and the protrusion 188, the panel 180 can comprise only the indentation 187 without the protrusion 188 (e.g., such that the panel 180 is configured to interface with a second panel having a protrusion 188) or only the protrusion 188 without the indentation 187 (e.g., such that the panel 180 is configured to interface with a second panel having an indentation 187). Furthermore, both the first end 185 and the second end 186 can include an indentation 187 (e.g., such that at least one of the ends 185, 186 is configured to interface with a second panel having a protrusion 188). Similarly, both the first end 185 and the second end 186 can include a protrusion 188 (e.g., such that at least one of the ends 185, 186 is configured to interface with a second panel having an indentation 187).

Figure 6:
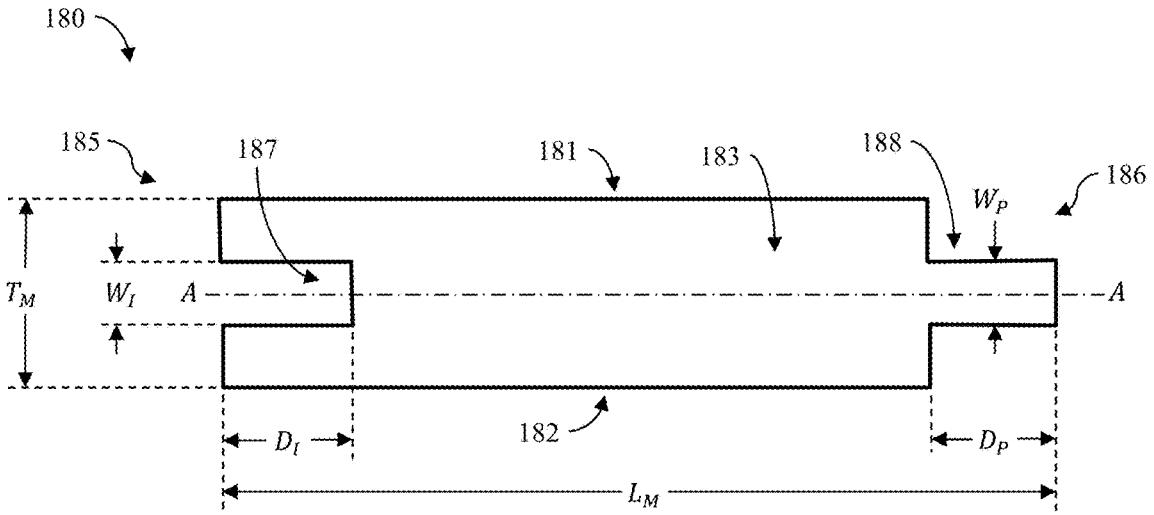
FIG. 6 is a plan view of an exemplary embodiment of a curtain wall insulation panel in accordance with the present disclosure.

As seen well in FIG. 6, the indentation 187 has an indentation width $W_I$, and the protrusion 188 has a protrusion width $W_P$. In embodiments, the indentation width $W_I$ is greater than or equal to about 0.5 inches (about 12.7 mm), about 1 inch (about 25.4 mm), about 1.5 inches (about 38.1 mm), about 2 inches (about 50.8 mm), about 3 inches (about 76.2 mm), about 4 inches (about 101.6 mm), etc. Further, in embodiments, the indentation width $W_I$ is less than or equal to about 4 inches (about 101.6 mm), about 3 inches (about 76.2 mm), about 2 inches (about 50.8 mm), about 1.5 inches (about 38.1 mm), about 1 inch (about 25.4 mm), about 0.5 inches (about 12.7 mm), etc. Moreover, in embodiments, the protrusion width $W_P$ is greater than or equal to about 0.5 inches (about 12.7 mm), about 1 inch (about 25.4 mm), about 1.5 inches (about 38.1 mm), about 2 inches (about 50.8 mm), about 3 inches (about 76.2 mm), about 4 inches (about 101.6 mm), etc. In embodiments, the protrusion width $W_P$ is less than or equal to about 4 inches (about 101.6 mm), about 3 inches (about 76.2 mm), about 2 inches (about 50.8 mm), about 1.5 inches (about 38.1 mm), about 1 inch (about 25.4 mm), about 0.5 inches (about 12.7 mm), etc.

With continued reference to FIG. 6, the indentation 187 and/or the protrusion 188 can be disposed on the panel 180 such that the panel 180 is symmetrical about axis A-A that bisects the material thickness $T_M$ of the panel 180. The axis A-A corresponds to a vertical plane parallel to and equidistant from the exterior facing surface 181 and the interior facing surface 182 of the panel 180. In other words, the panel 180 is symmetrical about the vertical plane. In an embodiment, the indentation 187 and/or the protrusion 188 are centered along a thickness direction of the panel 180. A ratio of the indentation width $W_I$ to the material thickness $T_M$ of the panel 180 is less than 1:1, such as about 2:3 or less, about 1:2 or less, about 1:3 or less, about 1:4 or less, etc. In an embodiment, the ratio of the indentation width $W_I$ to the material thickness $T_M$ of the panel 180 is about 1:3.

Furthermore, a ratio of the protrusion width $W_P$ to the material thickness $T_M$ of the panel 180 is less than 1:1, such as about 2:3 or less, about 1:2 or less, about 1:3 or less, about 1:4 or less, etc. In an embodiment, the ratio of the protrusion width $W_P$ to the material thickness $T_M$ of the panel 180 is about 1:3. In embodiments, the ratio of the indentation width $W_I$ to the material thickness $T_M$ and the ratio of the protrusion width $W_P$ to the material thickness $T_M$ are approximately equal.

Moreover, the indentation width $W_I$ can be approximately equal to the protrusion width $W_P$. In embodiments, the indentation width $W_I$ is less than the protrusion width $W_P$ such that a protrusion 188 having the protrusion width $W_P$ is compression fit within an indentation 187 having the indentation width $W_I$. In other words, a seam between two curtain wall insulation panels can be a compression fitted tongue-and-groove seam due to a protrusion being compression fit within a relatively narrower indentation. In embodiments, the indentation width $W_I$ is greater than the protrusion width $W_P$ such that a protrusion 188 having the protrusion width $W_P$ can be inserted without significant force into an indentation 187 having the indentation width $W_I$. In other words, a seam between two curtain wall insulation panels can be a loosely-fitted tongue-and-groove seam to allow for manufacturing tolerance variations of the indentation 187 and/or the protrusion 188 and improve ease of installation.

With continued reference to FIG. 6, the indentation 187 has an indentation depth $D_I$. In embodiments, the indentation depth $D_I$ is greater than or equal to about 0.5 inches (about 12.7 mm), about 1 inch (about 25.4 mm), about 1.5 inches (about 38.1 mm), about 2 inches (about 50.8 mm), about 3 inches (about 76.2 mm), about 4 inches (about 101.6 mm), etc. In embodiments, the indentation depth $D_I$ is less than or equal to about 4 inches (about 101.6 mm), about 3 inches (about 76.2 mm), about 2 inches (about 50.8 mm), about 1.5 inches (about 38.1 mm), about 1 inch (about 25.4 mm), about 0.5 inches (about 12.7 mm), etc. A ratio of the indentation depth $D_I$ to the indentation width $W_I$ is greater than about 1:2, such as about 2:3 or more, about 1:1 or more, about 3:2 or more, about 2:1 or more, about 3:1 or more, etc. In an embodiment, the ratio of the indentation depth $D_I$ to the indentation width $W_I$ is about 1:1.

As shown in FIG. 6, the protrusion 188 has a protrusion depth $D_P$. In embodiments, the protrusion depth $D_P$ is greater than or equal to about 0.5 inches (about 12.7 mm), about 1 inch (about 25.4 mm), about 1.5 inches (about 38.1 mm), about 2 inches (about 50.8 mm), about 3 inches (about 76.2 mm), about 4 inches (about 101.6 mm), etc. In embodiments, the protrusion depth $D_P$ is less than or equal to about 4 inches (about 101.6 mm), about 3 inches (about 76.2 mm), about 2 inches (about 50.8 mm), about 1.5 inches (about 38.1 mm), about 1 inch (about 25.4 mm), about 0.5 inches (about 12.7 mm), etc. A ratio of the protrusion depth $D_P$ to the protrusion width $W_P$ is greater than about 1:2, such as about 2:3 or more, about 1:1 or more, about 3:2 or more, about 2:1 or more, about 3:1 or more, etc. In an embodiment, the ratio of the protrusion depth $D_P$ to the protrusion width $W_P$ is about 1:1.

Further, the ratio of the indentation depth $D_I$ to the indentation width $W_I$ can be approximately equal to the ratio of the protrusion depth $D_P$ to the protrusion width $W_P$. Furthermore, the indentation depth $D_I$ can be approximately equal to the protrusion depth $D_P$. In embodiments the indentation depth $D_I$ is less than the protrusion depth $D_P$ such that a protrusion 188 having the protrusion depth $D_P$ crushes against an inner wall of an indentation 187 having the indentation depth $D_I$. Crushing the protrusion 188 can increase compression forces experienced by one or more panels 180 compression fit between mullions 151, 152, thereby increasing friction between ends of the panels 180 and the mullions 151, 152 and reducing the likelihood of the panels 180 coming loose from or falling out of the framing. In embodiments, the indentation depth $D_I$ is greater than the protrusion depth $D_P$ such that a protrusion 188 having the protrusion depth $D_P$ can be inserted without significant force into an indentation 187 having the indentation depth $D_I$. In other words, a seam between two curtain wall insulation panels can be a loosely-fitted tongue-and-groove seam to allow for manufacturing tolerance variations of the indentation 187 and/or the protrusion 188 and improve ease of installation.

Figure 7:
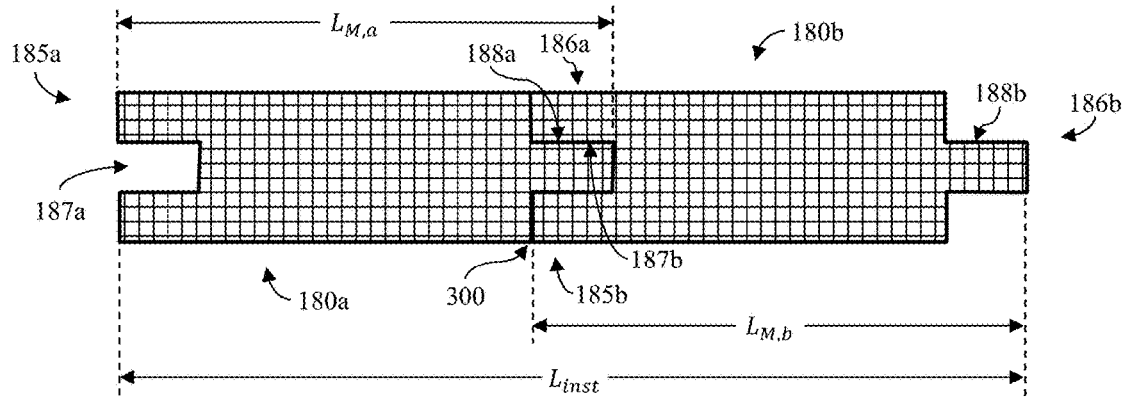
FIG. 7 is a plan view of a first curtain wall insulation panel and a second curtain wall insulation panel in accordance with an exemplary embodiment of the present disclosure.

Now referring to FIG. 7, a first curtain wall insulation panel 180*a* can interface with a second curtain wall insulation panel 180*b* to form a seam 300. For example, at least a portion of the first curtain wall insulation panel 180*a* is interdisposed with at least a portion of the second curtain wall insulation panel 180*b*. In other words, at least a portion of the second curtain wall insulation panel 180*b* overlaps with at least a portion of the first curtain wall insulation panel. In embodiments, the seam 300 is a tongue-and-groove seam.

With continued reference to FIG. 7, the first curtain wall insulation panel 180*a* includes a first end 185*a*, a second end 186*a*, and a first material length $L_{M,a}$. The first material length $L_{M,a}$ corresponds to the length measured from the first end 185*a* of the first panel 180*a* to the second end 186*a* of the first panel 180*a*. The second end 186*a* includes a first protrusion 188*a*, and the first end 185*a* can optionally include a first indentation 187*a*. Also shown in FIG. 7, the second curtain wall insulation panel 180*b* includes a first end 185*b*, a second end 186*b*, and a second material length $L_{M,b}$. The second material length $L_{M,b}$ corresponds to the length measured from the first end 185*b* of the second panel 180*b* to the second end 186*b* of the second panel 180*b*. The first end 185*b* includes a second indentation 187*b*, and the second end 186*b* can optionally include a second protrusion 188*b*. The first protrusion 188*a* of the first panel 180*a* is at least partially disposed within the second indentation 187*b* of the second panel 180*b*, for example, such that the seam 300 is formed in a tongue-and-groove fashion.

With continued reference to FIG. 7, an installed length $L_{inst}$ corresponds to the length measured from the first end 185*a* of the first panel 180*a* to the second end 186*b* of the second panel 180*b*. In embodiments where the first end 185*a* of the first panel 180*a* abuts a first mullion (e.g., mullion 151) and the second end 186*b* of the second panel 180*b* abuts a second mullion (e.g., mullion 152), the installed length $L_{inst}$ is at least approximately equal to a mullion distance $M_D$ measured between the first mullion and the second mullion, for example, such that a void between the first mullion and the second mullion is filled, thereby preventing smoke and/or flames from passing therethrough. The installed length $L_{inst}$ can be greater than the mullion distance $M_D$ such that the panels 180*a*, 180*b* are compression fit in a longitudinal direction between the first mullion and the second mullion.

Further, the first material length $L_{M,a}$ of the first panel 180*a* can be summed with the second material length $L_{M,b}$ of the second panel 180*b* to form a summed material length (not labeled). In accordance with the present disclosure, the summed material length is greater than or equal to the installed length $L_{inst}$. In exemplary embodiments, the summed material length is greater than the installed length $L_{inst}$ due to the overlapping nature of the seam 300 between the panels 180*a*, 180*b*, which effectively reduces the installed length $L_{inst}$. In embodiments, the summed material length is about 0.5 inches (about 12.7 mm) to about 36 inches (about 914.4 mm) greater than the installed length $L_{inst}$. In certain embodiments, the summed material length is about 1 inch (about 25.4 mm) to about 18 inches (about 457.2 mm) greater than the installed length $L_{inst}$. In embodiments, the summed material length is about 1.5 inches (about 38.1 mm) to about 12 inches (about 304.8 mm) greater than the installed length $L_{inst}$. In certain embodiments, the summed material length is about 2 inches (about 50.8 mm) to about 9 inches (about 228.6 mm) greater than the installed length $L_{inst}$. In embodiments, the summed material length is about 3 inches (about 76.2 mm) to about 8 inches (about 203.2 mm) greater than the installed length $L_{inst}$. In certain embodiments, the summed material length is about 4 inches (about 101.6 mm) to about 6 inches (about 152.4 mm) greater than the installed length $L_{inst}$. A percentage by which the summed material length $L_{M,sum}$ is greater than the installed length $L_{inst}$ can be calculated with Equation 1 below.

$$\frac{L_{M,sum} - L_{inst}}{L_{inst}} = \text{a percentage by which } L_{M,sum} \text{ is greater than } L_{inst} \quad (1)$$

In embodiments, the summed material length is about 0.35% to about 33% greater than the installed length $L_{inst}$. For example, a first panel and a second panel each have a material length of about 72 inches (about 1,829 mm), and an indentation depth $D_I$ of an indentation of the first panel and a protrusion depth $D_P$ of a protrusion of the second panel are each about 0.5 inches (about 12.7 mm). In such an example, the percentage by which the summed material length is greater than the installed length $L_{inst}$ is about 0.35%, since $$\frac{L_{M,sum} - L_{inst}}{L_{inst}} = \frac{(72 + 72) - (72 + 72 - 0.5)}{72 + 72 - 0.5} = 0.35\%.$$

As a further example, a first panel and a second panel can each have a material length of about 72 inches (about 1,829 mm), and an indentation depth $D_I$ of an indentation of the first panel and a protrusion depth $D_P$ of a protrusion of the second panel are each about 36 inches (914.4 mm). In such an example, the percentage by which the summed material length is greater than the installed length $L_{inst}$ is about 33%.

In certain embodiments, the summed material length is about 0.7% to about 14% greater than the installed length $L_{inst}$. For example, a first panel and a second panel can each have a material length of about 72 inches (about 1,829 mm), and an indentation depth $D_I$ of an indentation of the first panel and a protrusion depth $D_P$ of a protrusion of the second panel are each about 1 inch (about 25.4 mm). In such an example, the percentage by which the summed material length is greater than the installed length $L_{inst}$ is about 0.7%. As a further example, a first panel and a second panel can each have a material length of about 72 inches (about 1,829 mm), and an indentation depth $D_I$ of an indentation of the first panel and a protrusion depth $D_P$ of a protrusion of the second panel are each about 18 inches (about 914.4 mm). In such an example, the percentage by which the summed material length is greater than the installed length $L_{inst}$ is about 14%.

By having a summed material length that is greater than the installed length $L_{inst}$, the seam 300 is less likely to become compromised in the event of a fire as compared to a simple seam between flat, plain ends of conventional curtain wall insulation panels. Accordingly, the seam 300 of the present disclosure is sufficiently robust such that it can be utilized in the system 100 or the insulated curtain wall component 200 without having to apply separate seam reinforcing members such a false mullion 57 as required in the system 12 illustrated in FIG. 2. This in turn reduces the number of components required in the system 100 or the insulated curtain wall component 200, which can reduce labor and material costs for constructing the system 100 or the insulated curtain wall component 200. Moreover, since each of the panels 180*a*, 180*b* can have a length up to at least about 72 inches (about 1,829 mm), the panels 180*a*, 180*b* can be used in combination to span a mullion distance $M_D$ greater than 72 inches (1,829 mm) while still achieving a desired flame rating, such as a flame rating of at least 2 hours, as measured in accordance with ASTM E2307.

Figure 8:
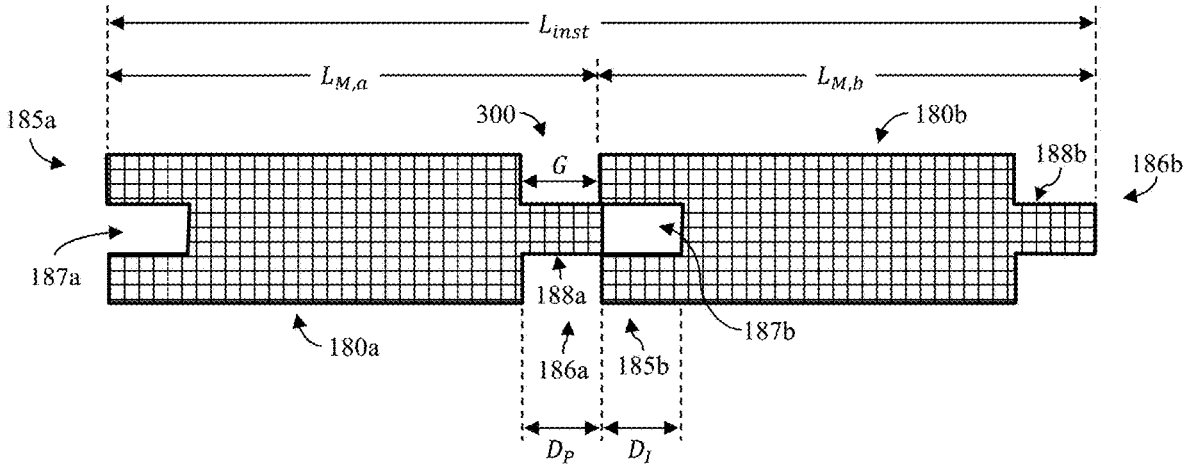
FIG. 8 is a plan view of a first curtain wall insulation panel and a second curtain wall insulation panel in accordance with an embodiment of the present disclosure.

Now referring to FIG. 8, in the event of a fire (e.g., in the event that the seam 300 is exposed to flames in accordance with the test methodology of ASTM E2307), the seam 300 may become partially compromised (i.e., spread apart, open up) to form a gap G between the second end 186*a* of the first panel 180*a* and the first end 185*b* of the second panel 180*b*. However, in embodiments, the gap G is less than or equal to at least one of a protrusion depth $D_P$ of the first protrusion 188*a* or the indentation depth $D_I$ of the second indentation 187*b* (i.e., the protrusion and the indentation comprising the seam 300). In embodiments, the gap G is less than or equal to at least one of a protrusion depth $D_P$ of the first protrusion 188*a* or the indentation depth $D_I$ of the second indentation 187*b* for at least 2 hours after the start of the fire. In other words, the seam 300 does not fully open such that the panels 180*a*, 180*b* no longer at least partially abut. In embodiments, a maximum amount the seam 300 will spread open during the first 2 hours of a fire is approximately equal to or less than at least one of a protrusion depth $D_P$ of the first protrusion 188*a* or the indentation depth $D_I$ of the second indentation 187*b*. FIG. 8 shows a most extreme case of the seam 300 opening up when exposed to the fire, wherein the gap G is approximately equal to at least one of the protrusion depth $D_P$ or the indentation depth $D_I$. Furthermore, in embodiments, the summed material length (i.e., $L_{M,a}$ plus $L_{M,b}$) is greater than or approximately equal to the installed length $L_{inst}$ of the panels 180*a*, 180*b* for at least 2 hours after the start of the fire. FIG. 8 shows a most extreme case of the seam 300 opening up when exposed to the fire, wherein the $L_{inst}$ is approximately equal to the summed material length.

Figure 9:
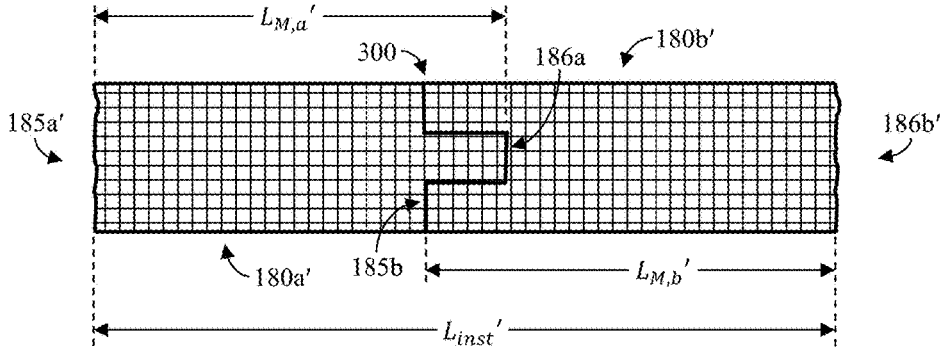
FIG. 9 is a plan view of a first curtain wall insulation panel and a second curtain wall insulation panel in accordance with an exemplary embodiment of the present disclosure.

Now referring to FIG. 9, curtain wall insulation panels 180*a*, 180*b* can be initially formed such that each end of the panels 180*a*, 180*b* includes at least one of a protrusion (e.g., 188*a*, 188*b*) or an indentation (e.g., 187*a*, 187*b*) and then subsequently processed (e.g., scored, cut, etc.) to remove a protrusion or an indentation from at least one end of a panel 180*a* and/or 180*b* to form a first trimmed panel 180*a*' and/or a second trimmed panel 180*b*'. As shown in FIG. 9, the first panel 180*a* can be processed to remove at least a portion of the first end 185*a* to form the first trimmed panel 180*a*'. For example, the first panel 180*a* can be processed such that the indentation 187*a* is at least partially or completely removed from the first end 185*a* to form a first trimmed end 185*a*' of the first trimmed panel 180*a*'. The first trimmed panel 180*a*' has a first trimmed material length $L_{M,a}$' measured from the first trimmed end 185*a*' of the first trimmed panel 180*a*' to a second end 186*a* of the first trimmed panel 180*a*'. Further, the second panel 180*b* can be processed to remove at least a portion of the second end 186*b* to form the second trimmed panel 180*b*'. For example, the second panel 180*b* can be processed such that the protrusion 188*b* is at least partially or completely removed from the second end 186*b* to form a second trimmed end 186*b*' of the second trimmed panel 180*b*'. The second trimmed panel 180*b*' has a second trimmed material length $L_{M,b}$' measured from a first end 185*b* of the second trimmed panel 180*b*' to the second trimmed end 186*b*' of the second trimmed panel 180*b*'.

Furthermore, the first trimmed material length $L_{M,a}'$ can be summed with the second trimmed material length $L_{M,b}'$ to form a summed trimmed material length (not labeled). A trimmed installed length $L_{inst}'$ of the first trimmed insulation panel 180*a*' and the second trimmed insulation panel 180*b*' can be measured from the first trimmed end 185*a*' of the first trimmed insulation panel 180*a*' to the second trimmed end 186*b*' of the second trimmed panel 180*b*'. In accordance with the present disclosure, the summed trimmed material length is greater than or equal to the installed length $L_{inst}'$. Moreover, the first trimmed panel 180*a*' and the second trimmed panel 180*b*' can interface to form the seam 300. For example, the first trimmed panel 180*a*' can include the second end 186*a* (i.e., an untrimmed end) having a protrusion that is at least partially disposed within an indentation of the first end 185*b* (i.e., an untrimmed end) of the second trimmed panel 180*b*'. Trimming an end of a panel as described herein can advantageously limit voids between the end of the panel and a mullion that the end abuts, thereby limiting potential pathways for smoke, hot gases, and/or flames to pass therethrough. While the trimmed ends 185*a*', 186*b*' are illustrated as wavy lines in the plan view of in FIG. 9, the trimmed end 185*a*' or 186*b*' can be illustrated as a straight line (i.e., a clean cut) such that the trimmed end 185*a*' or 186*b*' comprises a substantially flat surface that abuts with a substantially flat surface of a mullion.

The curtain wall insulation described herein (i.e., panels 180, 180*a*, 180*b*, 180*a*', 180*b*', etc.) may be formed of various materials based on a desired failure temperature of the material. In embodiments, the curtain wall insulation panel comprises mineral wool. Such curtain wall insulation 180 is commercially available from Thermafiber, Inc. (Joplin, Missouri). The curtain wall insulation 180 may have a thickness of about 1 inch (about 25.4 mm) to about 8 inches (about 203.2 mm) or more and a density of at least about 64 kg/m$^3$ to about 225 kg/m$^3$ or more. In certain embodiments, the curtain wall insulation 180 has a thickness of at least about 3 inches (e.g., about 3 inches to about 8 inches). In certain embodiments, the curtain wall insulation 180 has a density of at least about 96 kg/m$^3$ (e.g., about 96 kg/m$^3$ to about 225 kg/m$^3$). As described herein, the curtain wall insulation 180 is disposed within the framing. Accordingly, the size and shape of the curtain wall insulation 180 will typically depend on the size and shape of the framing into which the curtain wall insulation 180 is being installed. In certain aspects, the curtain wall insulation 180 is mechanically attached to the framing, for example, with insulation hangers (not shown), such as Impasse® insulation hangers available from Thermafiber, Inc. (Joplin, Missouri), or by other conventional means used to mechanically attach curtain wall insulation 180 to the framing, such as impaling pins or screws. In certain aspects, the curtain wall insulation 180 is friction fit within the framing, as further described herein.

While the exemplary drawings herein show an end of a curtain wall insulation panel having either a single indentation or a single protrusion, the general inventive concepts are not so limited. For example, it is within the scope of the inventive concepts to provide the end of the curtain wall insulation panel with more than one indentations and/or more than one protrusions.

Further, while a seam between curtain wall insulation panels may be shown or described herein as a vertical seam, the general inventive concepts are not so limited. For example, the seam may be a horizontal seam, such as in a system or an insulated curtain wall component where a transom distance is greater than a maximum manufacturable height of curtain wall insulation panels. Accordingly, the seam may be in any orientation such that one or more curtain wall insulation panels can span a distance within a framing of a curtain wall structure where the distance is greater than a maximum manufacturable dimension of the curtain wall insulation panels.

Furthermore, while the exemplary drawings show first and second curtain wall insulation panels as having substantially similar material thicknesses such that the interior facing surfaces of the panels form a substantially flat and continuous surface and such that the exterior facing surfaces of the panels form a substantially flat and continuous surface, the general inventive concepts are not so limited. For example, a material thickness of at least one of the panels can be varied, for example, to accommodate variations in a size of the framing that receives the panels. In other words, the exterior facing surfaces of the panels may lie on different planes and/or the interior facing surfaces of the panels may lie on different planes.

Moreover, while the exemplary drawings show a first curtain wall insulation panel (e.g., 180*a*) and a second curtain wall insulation panel (e.g., 180*b*) being sufficient to span a mullion distance $M_D$, the general inventive concepts are not so limited. For example, it is contemplated that more than two curtain wall insulation panels may be needed to span the mullion distance $M_D$. In an embodiment where the mullion distance $M_D$ is greater than twice a maximum manufacturable length of curtain wall insulation panels (e.g., greater than about 144 inches or about 3,658 mm), three or more insulation panels may be needed such that an installed length $L_{inst}$ is greater than or approximately equal to the mullion distance $M_D$.

Further, while a mullion distance $M_D$ of a system or curtain wall insulation component may be shown or described herein as being greater than or equal to a maximum manufacturable length of a curtain wall insulation panel, the mullion distance $M_D$ may be less than or equal to a maximum manufacturable length of the curtain wall insulation panel and the system or curtain wall insulation component may nonetheless benefit from including a seam as described herein. For example, in a system where the mullion distance $M_D$ is less than the maximum manufacturable length of a curtain wall insulation panel having a protrusion on a first end and an indentation on a second end, the curtain wall insulation panel may be cut (e.g., through a thickness of the panel to form more than one lengthwise portions of the panel) to form a first trimmed curtain wall insulation panel having the protrusion on a first end and a first trimmed end on a second end of the first trimmed panel and a second trimmed curtain wall insulation panel having the indentation on a first end and a second trimmed end on a second end of the second trimmed panel. The first trimmed panel and the second trimmed panel may be configured to be disposed in the system such that the protrusion of the first trimmed panel is at least partially disposed within the indentation of the second trimmed panel. Further, the first trimmed end of the first trimmed panel may abut a first mullion, and the second trimmed end of the second trimmed panel may abut a second mullion of the framing. Moreover, it may be advantageous to manufacture curtain wall insulation panels having a length less than a maximum manufacturable length (e.g., to address manufacturing, packaging, or shipping issues). For example, a system can include a seam as described herein that is formed between first and second curtain wall insulation panels having a length less than a maximum manufacturable length (e.g., about 50% of the maximum manufacturable length). In such an example, a mullion distance $M_D$ can be approximately equal to the maximum manufacturable length of a curtain wall insulation panel, and the seam may nonetheless be included in the system. Accordingly, a seam as described herein may be included in a system or curtain wall insulation component having any distance within a framing with or without regard to a maximum manufacturable dimension of a curtain wall insulation panel that is configured to be at least partially disposed within the framing.

Furthermore, it is contemplated that a protrusion or an indentation on an end of a curtain wall insulation panel can interface with a corresponding indentation or protrusion on a surface of a framing member (e.g., a mullion or transom) that the end of the curtain wall insulation panel abuts. Accordingly, it is within the scope of the general inventive concepts for a system for insulating a curtain wall structure or an insulated curtain wall component to include one or more curtain wall insulation panels that form one or more seams, where the seam may be formed with another curtain wall insulation panel or with a framing member.

The terminology as set forth herein is for description of the embodiments only and should not be construed as limiting the disclosure as a whole. All references to singular characteristics or limitations of the present disclosure shall include the corresponding plural characteristic or limitation, and vice versa, unless otherwise specified or clearly implied to the contrary by the context in which the reference is made. Unless otherwise specified, "a," "an," "the," and "at least one" are used interchangeably. Furthermore, as used in the description and the appended claims, the singular forms "a," "an," and "the" are inclusive of their plural forms, unless the context clearly indicates otherwise.

To the extent that the term "includes" or "including" is used in the description or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. Furthermore, when the phrase "one or more of A and B" is employed, it is intended to mean "only A, only B, or both A and B." Similarly, when the phrases "at least one of A, B, and C" or "at least one of A, B, C, and combinations thereof" are employed, they are intended to mean "only A, only B, only C, or any combination of A, B, and C" (e.g., A and B; B and C; A and C; A, B, and C).

The system of the present disclosure can comprise, consist of, or consist essentially of the essential elements of the disclosure as described herein, as well as any additional or optional element or feature described herein, or which is otherwise useful in curtain wall insulation applications, such as smoke sealant applied to a safing insulation or mullion cover insulation applied to a mullion.

All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, and 10) contained within the range.

Unless otherwise indicated herein, all sub-embodiments and optional embodiments are respective sub-embodiments and optional embodiments to all embodiments described herein. While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details and illustrative examples shown and described. Accordingly, departures may be made from such details without departing from the spirit or scope of applicant's general disclosure herein.

The scope of the general inventive concepts presented herein are not intended to be limited to the particular exemplary embodiments shown and described herein. From the disclosure given, those skilled in the art will not only understand the general inventive concepts and their attendant advantages but will also find apparent various changes and modifications to the devices and systems disclosed. It is sought, therefore, to cover all such changes and modifications as fall within the spirit and scope of the general inventive concepts, as described and/or claimed herein, and any equivalents thereof.

What is claimed is:

1. A system for insulating a curtain wall structure connected to a building structure, the curtain wall structure having framing defined by at least first and second vertically disposed and parallel mullions separated by a mullion distance, the system comprising:

a first curtain wall insulation panel having:
- a first face,
- a second face opposite the first face,
- a material thickness defined between the first face and the second face,
- a first end having a longitudinally extending indentation,
- a second end opposite the first end, and
- a first material length defined between the first end and the second end; and a second curtain wall insulation panel having:
- a first face,
- a second face opposite the first face,
- a material thickness defined between the first face and the second face,
- a first end having a longitudinally extending protrusion,
- a second end opposite the first end, and
- a second material length defined between the first end and the second end, wherein at least one of the material thickness of the first panel and the material thickness of the second panel is at least about 3 inches (about 76.2 mm);

wherein the first panel and the second panel are configured to be disposed within the framing such that the longitudinally extending protrusion of the second panel is at least partially disposed within the longitudinally extending indentation of the first panel;

wherein the system has a flame rating of at least 2 hours, as measured in accordance with ASTM E2307; and wherein for at least the first two hours of a fire on a floor below and adjacent to the first and second curtain wall insulation panels, the longitudinally extending protrusion remains at least partially disposed within the longitudinally extending indentation.

2. The system of claim 1, wherein a sum of the first material length and the second material length comprises a summed material length that is greater than or approximately equal to an installed length measured from the second end of the first panel to the second end of the second panel.

3. The system of claim 2, wherein the installed length of the first panel and the second panel is approximately equal to the mullion distance.

4. The system of claim 2, wherein the installed length of the first panel and the second panel is less than the mullion distance.

5. The system of claim 1, wherein the mullion distance is at least about 72 inches (about 1,829 mm).

6. The system of claim 1, wherein a ratio of a width of the indentation of the first panel to the material thickness of the first panel is about 1:3.

7. The system of claim 1, wherein a ratio of a width of the protrusion of the second panel to the material thickness of the second panel is about 1:3.

8. The system of claim 1, wherein a width of the indentation of the first panel is approximately equal to a width of the protrusion of the second panel.

9. The system of claim 1, wherein a width of the indentation of the first panel is greater than a width of the protrusion of the second panel.

10. The system of claim 1, wherein a ratio of a depth of the indentation of the first panel to a width of the indentation of the first panel is about 1:1.

11. The system of claim 1, wherein a ratio of a depth of the protrusion of the second panel to a width of the protrusion of the second panel is about 1:1.

12. The system of claim 1, wherein a depth of the indentation of the first panel is approximately equal to a depth of the protrusion of the second panel.

13. The system of claim 1, wherein the second end of the first panel comprises a second longitudinally extending protrusion and the second end of the second panel comprises a second longitudinally extending indentation.

14. The system of claim 1, wherein at least one of the first panel or the second panel is symmetrical about at least one of a horizontal plane perpendicular to at least one of the first face or the second face of at least one of the first panel or the second panel or a vertical plane parallel at least one of the first face or the second face of at least one of the first panel or the second panel.

15. The system of claim 1, wherein at least one of the first panel or the second panel is asymmetrical about at least one of a horizontal plane perpendicular to at least one of the first face or the second face of at least one of the first panel or the second panel or a vertical plane parallel at least one of the first face or the second face of at least one of the first panel or the second panel.

16. The system of claim 1, wherein the framing is further defined by at least first and second horizontally disposed and parallel transoms separated by a transom distance, wherein the transom distance is less than or equal to about 24 inches (about 610 mm).

17. The system of claim 1, wherein at least one of the first panel or the second panel comprises mineral wool.

18. The system of claim 1, wherein at least one of the first panel or the second panel has a density of at least about 96 $kg/m^3$.

19. A curtain wall structure connected to a building structure, the curtain wall structure comprising:

- a framing comprising a first and a second vertically disposed and parallel mullions separated by a mullion distance of at least about 72 inches (about 1,829 mm); and
- a system for insulating the curtain wall, comprising:
  - a first curtain wall insulation panel having:
    - a first face,
    - a second face opposite the first face,
    - a material thickness defined between the first face and the second face,
    - a first end having a longitudinally extending indentation,
    - a second end opposite the first end, and
    - a first material length defined between the first end and the second end; and
  - a second curtain wall insulation panel having:
    - a first face,
    - a second face opposite the first face,
    - a material thickness defined between the first face and the second face,
    - a first end having a longitudinally extending protrusion,
    - a second end opposite the first end, and
    - a second material length defined between the first end and the second end,
- wherein at least one of the material thickness of the first panel and the material thickness of the second panel is at least about 3 inches (about 76.2 mm);
- wherein the first panel and the second panel are configured to be disposed within the framing such that the longitudinally extending protrusion of the second panel is at least partially disposed within the longitudinally extending indentation of the first panel;
- wherein the system has a flame rating of at least 2 hours, as measured in accordance with ASTM E2307; and
- wherein for at least the first two hours of a fire on a floor below and adjacent to the first and second curtain wall insulation panels, the longitudinally extending protrusion remains at least partially disposed within the longitudinally extending indentation.

* * * * *